US006011213A

United States Patent [19]

Duruöz

[11] Patent Number: 6,011,213

[45] Date of Patent: Jan. 4, 2000

[54] SYNTHESIS OF SOUNDS PLAYED ON PLUCKED STRING INSTRUMENTS, USING COMPUTERS AND SYNTHESIZERS

[75] Inventor: Cem I. Duruöz, San Francisco, Calif.

[73] Assignees: Sony Corporation, Tokyo, Japan; Sony Electronics Inc., Park Ridge, N.J.

[21] Appl. No.: 08/935,460

[22] Filed: Sep. 24, 1997

[51] Int. Cl.[7] ..... G10H 1/02; G10H 1/12

[52] U.S. Cl. ..... 84/703; 84/622; 84/627; 84/659; 84/663; 84/702; 84/DIG. 9

[58] Field of Search ..... 84/622, 627, 659–661, 84/663, 624, 696, 702–703, 738, DIG. 9

[56] References Cited

U.S. PATENT DOCUMENTS

| | | | |
|---|---|---|---|
| 4,130,043 | 12/1978 | Niimi | 84/103 |
| 4,524,668 | 6/1985 | Tomisawa et al. | 84/1.24 |
| 4,984,276 | 1/1991 | Smith | 381/63 |
| 5,180,877 | 1/1993 | Kunimoto | 84/624 |
| 5,256,830 | 10/1993 | Takeuchi et al. | 84/625 |
| 5,471,007 | 11/1995 | Van Duyne et al. | 84/622 |
| 5,587,548 | 12/1996 | Smith, III | 84/659 |
| 5,777,255 | 7/1998 | Smith, III et al. | 84/661 |

OTHER PUBLICATIONS

Chaigne et al., *Numerical simulations of piano strings, I. A physical model for a struck string using finite difference methods.*, J. Acoust. Soc. Am. 95(2), Feb. 1994, pp. 1112–1118.

A. Chaigne. *On the use of finite differences for musical synthesis. Application to plucked stringed instruments.*, J. Acoustique 5 (1992) pp. 181–211.

A. Chaigne, *Viscoelastic properties of nylon guitar strings.*, Catgut Acoust. Soc. J. vol. 1, No. 7 (Series II) May 1991, pp. 21–43.

P. Cook, *A meta–wind–instrument physical model, and a meta–controller for real time performance control*, Proc. ICMC, San Jose, pp. 273–276, 1992.

Jaffe et al., *Extensions of the karplus–Strong Plucked String Algoritm.*, Computer Music Journal, vol. 7, No. 2, 1983, pp. 56–69.

Karjalainen et al., *Body Modeling Techniques for String Instrument Synthesis*, Proc. ICMC, Hong Kong, pp. 232–239, 1998.

Karplus et al., *Digital Synthesis of Plucked–String and Drum Timbres*, Computer Music Journal, vol. 7, No. 2, 1983, pp. 43–55.

Lambourg et al., *Measurements and Modeling of the Admittance Matrix at the Bridge in Guitars*, SMAC 93, Proceedings.

Bradley et al., *Automated Analysis and Computationally Efficient Synthesis of Acoustic Guitar Strings and Body*, IEEE Mohonk Proceedings 1995.

Smith III, Julius O., *Discrete–Time Modeling of Acoustic Systems*, Stanford Report, Draft May 4, 1995.

*Primary Examiner*—Robert E. Nappi
*Assistant Examiner*—Marlon T. Fletcher
*Attorney, Agent, or Firm*—Wood, Herron & Evans, L.L.P.

[57] ABSTRACT

A sound synthesizer for a plucked string instrument simulates noises and transients produced before and after and during the transitions between notes. A particularly convincing synthesis of a plucked string instrument is produced by combining the transients into the final output. In particular, the transient tap tone and longitudinal vibration of the string resulting from the string pluck, and the damping tap tones resulting from the string damping, are all simulated. In one embodiment, the tap tone created upon attack and plucking of a string, is synthesized, and then used to stimulate a resonant circuit, thereby simulating both the pluck tap tone, and the transverse vibration of the string. In addition, the final damping transients which occur at the end of an articulated note are also simulated, using either an independent transient synthesis section, or by stimulating the resonant circuit with a tap tone, while simultaneously re-tuning that resonant circuit.

32 Claims, 4 Drawing Sheets

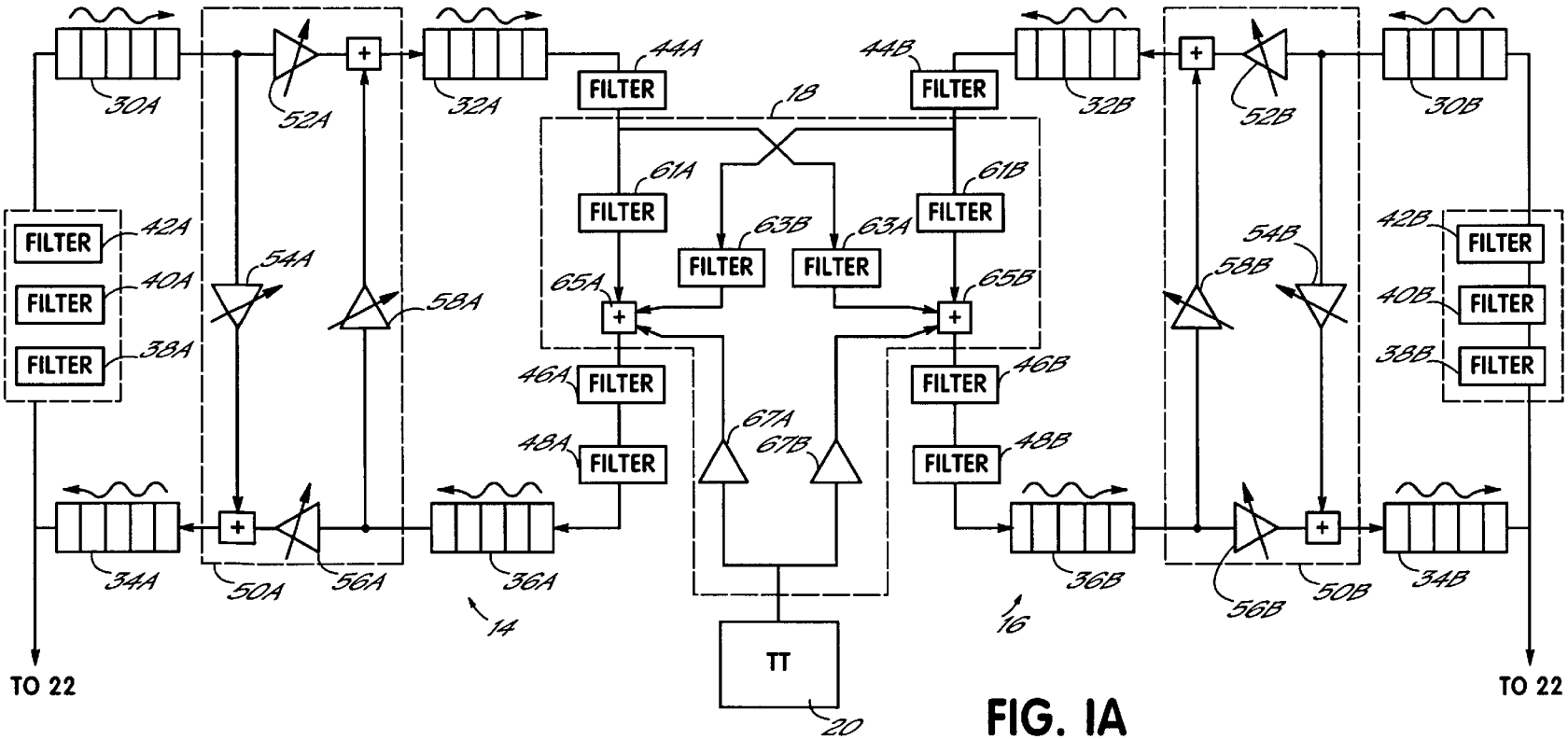
FIG. IA

SYNTHESIS OF SOUNDS PLAYED ON PLUCKED STRING INSTRUMENTS, USING COMPUTERS AND SYNTHESIZERS

FIELD OF THE INVENTION

The present invention relates to simulation of the sounds produced by plucked string instruments.

REFERENCE TO SOFTWARE APPENDIX

A software appendix is attached to this application. This appendix is subject to copyright protection. The applicant has no objection to the reproduction of this appendix, in the form in which it appears in the files of the U.S. Patent and Trademark Office, but reserves all other rights under copyright law.

BACKGROUND OF THE INVENTION

With recent developments in the integrated circuit technology, it has become possible to build synthesizers or computers which can process sound samples rapidly and efficiently. Indeed, in some music production and performance contexts, such as pop music concerts and recordings, it has become convenient and inexpensive to use synthesizers or electronic instruments instead of live performers. The "Clavinova" produced by Yamaha, MIDI guitars, and synthesizers produced by Kurzweil and Yamaha, are examples of popular electronic instruments.

The ultimate goal in the design of these instruments is to obtain sounds as close as possible to the synthesized instrument, for the complete pitch range, while maintaining low cost and complexity. To achieve this goal, sound perception and psycho acoustics must be well understood, to determine which components of the sound are significant to the human ear, in order to simplify synthesis models without sacrificing sound quality.

The current state of the art synthesizers, in general, use a combination of wavetable synthesis, FM synthesis and additive synthesis methods. There are some very new models which also incorporate physical modeling synthesis. In wavetable synthesis, some portion or all of the sound of the acoustic instrument note is digitally recorded. Then the recorded sound data is digitally processed to obtain notes with various amplitudes, durations, pitches and other expressive parameters specific to that instrument. In FM synthesis, no pre-recorded sound data is used; rather, pairs of oscillators produce frequency and amplitude modulated sine waves which are added after being properly enveloped and weighted. In additive synthesis, the frequency components of the sound are separately produced, enveloped and added. Pure additive synthesis is not commercially viable since the number of components which have to be used for a realistic sound is very high, especially for the synthesis of transient and non-linear portions. Finally, in physical modeling synthesis, the equations which govern the instrument's wave propagation, are solved numerically, with the results producing the sound samples.

Different ones of these methods, or combinations of these methods, have been found to be successful in the synthesis of different specific instruments. In particular, FM and wavetable synthesis methods are very successfully applied to pianos, most percussive instruments and some wind instruments in some pitch ranges. Physical modeling synthesis, on the other hand, is very powerful in the synthesis of sounds produced by non-linear effects, which are particularly significant in bowed string instruments or all wind instruments. However, physical modeling synthesis models are very new and difficult to implement, and as a result are not yet commercially viable.

SUMMARY OF THE INVENTION

A drawback with a typical state of the art sound synthesizer, is the manner in which the synthesizer produces articulation between notes. Even if an isolated single note is synthesized perfectly, an improper articulation of several notes played in sequence, may make the sound unrealistic. Especially the noises, and transients which are produced during the transitions between notes are very important elements. For some instruments such as flute, this is an extremely important issue, since during transitions, there are nonlinear effects, which can not be simulated successfully with either FM synthesis or wavetable synthesis.

Furthermore, state of the art synthesizers also fail in adequately representing transients in the reproduced sounds. When the output of a typical synthesizer is studied carefully, it is often found that a synthesized plucked string instrument note, lacks the transients which are found in a live recording of an actual instrument. These transients are not only crucial for the successful synthesis of an articulated sequence of notes, but also isolated single notes. "Classical guitar" (nylon string acoustical guitar), is a very good example: typical FM or physical modeling synthesis for this instrument lacks the percussive body sound, known as the "tap sound", which results from the vibration of the wood from the initial strike against the string, as well as the longitudinal mode vibration of the string produced by the initial strike, which is heard only during the brief period prior to the release of the string. Without these elements, synthesized individual or articulated note sounds are easily distinguishable from sounds produced by real instruments.

Wavetable synthesis may include these transient elements, if the wavetables are properly recorded; however, in current wavetable synthesizers, the transients are not separately recorded, and it is impossible to manipulate the transients independently of the underlying notes; this means that while the reproductive quality may be very good for pitches, note tempos and durations which approximate those of the original recording, for most pitches, note tempos and durations, the transients will not match those that would be produced by a live instrument, and the reproduction quality will be poor.

In accordance with principles of the present invention, the significant transient sounds which are produced by plucked string instruments are simulated, in addition to the primary string vibrations which are simulated by prior systems. A particularly convincing synthesis of a plucked string instrument is produced by combining the transients into the final output.

Specifically, in one aspect, the invention features simulation of attack (or pluck) transients, using a resonant circuit tuned to the fundamental natural frequency of the plucked string, by stimulating the resonant circuit with a transient corresponding to plucking of the string. Thus, a synthesizer for producing a simulation of the sound of a plucked string instrument, includes a resonant circuit and a transient synthesis section. The transient synthesis section produces a simulation of an audible attack transient, which has a first duration. The resonant circuit is tuned to produce an audible tone corresponding to the simulated note, which has a duration longer than the first duration. The output of the transient synthesis section is fed into the resonant circuit to stimulate the resonant circuit to produce an audible tone simulating the sound of the plucked string instrument.

In another aspect, the invention features simulation of both transient longitudinal vibration of the string, as well as longer-term transverse vibration of the string. Thus, a synthesizer for producing a simulation of the sound of a plucked string instrument, includes a transverse synthesis section for producing a simulation of an audible tone for the transverse vibration of the string, and a longitudinal synthesis section for producing a simulation of the longitudinal vibration of the string. The outputs of the transverse and longitudinal synthesis sections are combined to produce an output signal simulating the sound of the plucked string instrument.

In specific embodiments of this aspect, the longitudinal synthesis section is stimulated by a sawtooth waveform, thus simulating the transients produced upon plucking a wound string of a plucked string instrument.

In a third aspect, the invention features simulation of transients during final damping of a simulated note.

In one embodiment, the damping noise is simulated by an independent transient synthesis section. A synthesizer for producing a simulation of the sound of a plucked string instrument, includes a note synthesis section and a transient synthesis section. The note synthesis section produces a simulation of an audible tone corresponding to the simulated note, which has a duration extending from the time of a simulated pluck of a string through a final damping period preceding a subsequent simulated pluck of a string. The transient synthesis section produces a simulation of an audible transient, which has a second duration shorter than the first duration, occurring during the final damping period. The outputs of the note and transient synthesis sections are combined to produce an output signal simulating the sound of the plucked string instrument during the damping period.

In another embodiment, the damping noise is simulated by retuning the note synthesizer during the damping period. Specifically, the note synthesizer includes first and second filters, and first and second delay elements which respectively connect signals output from the first filter to the input of the second filter, and connect signals output from the second filter to the input of the first filter. The note synthesizer further includes a scattering junction coupled to the first and second delay elements, for reflecting an adjustable portion of signals passing through the first delay element into the second delay element, and vice-versa. For simulation of damping, the scattering junction is adjusted to reflect a substantially larger portion of these signals than prior to damping.

The above and other objects and advantages of the present invention shall be made apparent from the accompanying drawings and the description thereof.

BRIEF DESCRIPTION OF THE DRAWING

The accompanying drawings, which are incorporated in and constitute a part of this specification, illustrate embodiments of the invention and, together with a general description of the invention given above, and the detailed description of the embodiments given below, serve to explain the principles of the invention.

FIG. 1A is a detailed block diagram of the transverse vibratory tone and bridge filter sections of the plucked string instrument synthesizer of FIG. 1;

DETAILED DESCRIPTION OF SPECIFIC EMBODIMENTS

Figure 1:
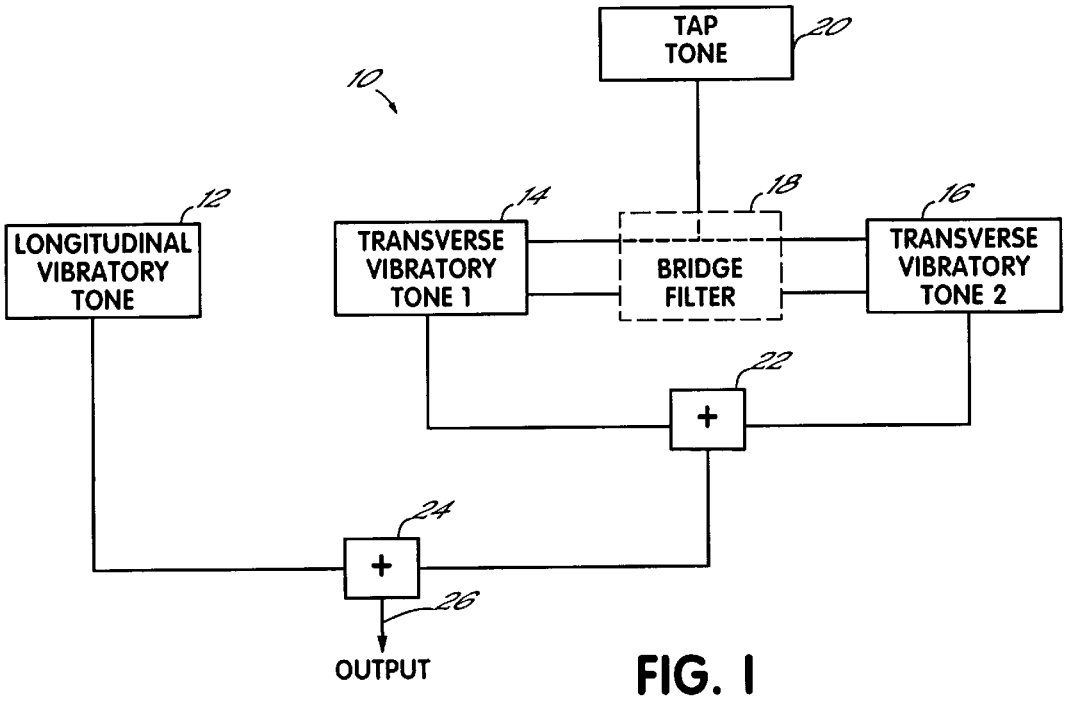
FIG. 1 is a block diagram of a first embodiment of a plucked string instrument synthesizer in accordance with principles of the present invention.

For the purposes of the following detailed description, various terms will first be defined for simplification of the following discussion:

Plucked String Instrument (PSI): The term "Plucked String Instrument" describes a musical instrument containing a "String" which can be set into vibration by a "Plucking Device" and which is connected to a "Body". Examples include all varieties of guitars, including but not limited to classical, electric, folk, flamenco, steel string, nylon string; all varieties of mandolins and banjos; all varieties of plucked fretted or unfretted lutes including but not limited to baroque lute, renaissance lute, ud, saz, tambura; all varieties of citterns; all varieties of harps; all varieties of lyres; all varieties of bowed string instruments when they are plucked using techniques such as pizzicalo,; and all varieties of plucked zithers including but not limited to harpsichord, virginal, spinet, koto and vina.

Plucking Device (PD): The "Plucking Device" is the tool which is used to set the string of the Plucked String Instrument into motion by exciting it longitudinally and/or transversely, by setting its initial condition (typically stretched transversely to the length of the string) and releasing it. Examples include but are not limited to the human finger nail, the human finger itself and all varieties of plectra made of any material.

String: The "String" of the PSI is the elongated cylindrical part which can vibrate longitudinally and transversely to produce an audible sound. The String is made of a material which has a much lower stiffness compared to the other parts of the instrument. The stiffness of the string is related to material constants such as Young's Modulus and Bulk Modulus. The string material may be but is not limited to nylon, gut, steel, and wound nylon coated or uncoated.

Body: The "Body" of the PSI is the portion to which the strings are connected. Depending on its stiffness and its size, it may significantly resonate with the string and therefore act like a resonator. However, for some instruments, the body is so small, or it is so stiff as in electric guitars, it does not resonate with the string vibration. The Body can be made of any material, such as wood, metal and polymers (plastic).

Resonator: The resonator of the PSI is the body itself or the piece connected to it. The examples of resonators include but are not limited to hollow wooden tubes or boxes of any shape and material as in classical guitars, harpsichords, or lute.

Longitudinal Vibrational Tone (LVT): The tone produced due to the longitudinal mode of vibration of the String. This mode is usually excited by the sliding motion of the Plucking Device along the length of the string. Depending on the texture of the string, for example wound or rough, the LVT may coexist with sounds which can be represented by white noise.

Tap Tone (TT): A percussive tone produced by interaction of the String and the Body or Resonator, when the PD releases the string to play a note, or damps the string as part of preparing to play a subsequent note.

Damping Noise (DN): The buzzing noise heard when the position of the PD is so close to the String that the amplitude of the string is constrained by the PD. This causes some loss of energy, and a transient which can be represented by a clipped sinusoid. Damping Noise is also generated, and is a significant part of the generated sound, in instruments like banjo in which the strings are so close to the Body that the transverse motion of the string is constrained by the body.

Transverse Vibrational Tone (TVT): The tone produced by the vibration of the string in the direction transverse to the length of the string. Usually, this mode of vibration continues for a relatively lengthy duration as compared to the LVT and TT, and is the basis for the perceived pitch of the played note. The transverse vibration has two components, since the String is free to vibrate in two dimensions.

As an initial background, it is useful to elaborate the modes of vibration of a string in a plucked string instrument. The vibration of strings can be divided into two components: Longitudinal and transverse. The transverse vibrations result from the movement of the string molecules in the plane perpendicular to the elongated axis of the string. Since in this plane two Cartesian coordinates can be defined, there two transverse modes. These can be thought of being the vibrations in y and z directions, if the string extends in the x direction.

To first order, these two transverse modes are independent from each other. In this case, the fundamental frequency $f_0$ for each transverse mode is then given by $$f_0 = \frac{1}{2L}\sqrt{\frac{T}{\rho}}$$

where T is the tension of the string, ρ is its volume density and L is its length. ρ is taken to be a constant, which is a valid assumption if the string is homogenous.

Second and higher order corrections, however, must be considered for a successful synthesis model of string instrument sounds. For most string instruments, the point where the string is attached to body, is not symmetric in y and z. This means that, the boundary conditions in y and z are not the same, and this results in different fundamental frequencies and their harmonics. Another reason for the difference is related to the coupling to the bridge of the plucked string instrument. The admittance to the bridge is not the same in these two directions.

The coupling between the two transverse modes manifests itself in a perceived "beating" in the vibration, that is, perception of simultaneous out-of-phase transverse vibrations of potentially slightly different fundamental frequencies. In strings which are not sufficiently homogenous, for example due to extended use and/or manufacturing defects or variable material properties, this beating can be heard very well.

Strings also exhibit a longitudinal vibration. The longitudinal vibration results from compression and expansion of the string material along its elongated direction. (This vibrational mode is similar to the vibrational modes which are the primary basis for sound in cylindrical wind instruments such as flute and pipe organ, in which a column of air inside the instrument is compressed and expanded along its length to produce the perceived note.) To first order, the frequency of the longitudinal vibration of a string, is independent of the tension of the string. In contrast to transverse vibrations, the fundamental frequency of longitudinal vibration is given by $$f_0 = \frac{1}{2L}\sqrt{\frac{E}{\rho_0}}$$

Here $f_0$, E, $\rho_0$ and L are the fundamental frequency, Young's Modulus, mass density and string length respectively.

The longitudinal vibratory mode is typically stimulated by plucking of a string in a plucked string instrument. For example, in a classical guitar, the longitudinal vibratory mode is excited by the lateral sliding motion of the player's fingernail along the string as part of plucking the string. In general, the angle of the plucking device determines how strongly this mode will be excited. Specifically, when the plucking device strikes the string orthogonal to the elongated axis of the string, the stimulation of the longitudinal vibratory is minimized. As the angle of the plucking device approaches the elongated axis of the string, the stimulation of the longitudinal vibratory mode is increased.

Note that the longitudinal vibratory frequency is independent of string tension, to first order. This is consistent with the experimental observation that, even if the tuning of a string is changed, the fundamental frequency heard in the transients prior to the transverse vibration remains constant. Note that the Young's modulus itself can vary over time and depends on the tension of the string. Using $E=4.5\times10^9$ N/m$^2$ and $\rho_0=1.067$ g/cm$^3$ for the G string vibration in a classical guitar, gives $f_0=1600$ Hz. An experimental value obtained from recorded samples is 1546 Hz. These and other numerical values establish the fact that the sliding motion of the plucking device indeed excites the longitudinal mode.

The body and the resonator of a string instrument have their own vibrational modes. Since the body is a three dimensional structure, its modes are much more complicated than that of the string, and the responses produced when the body is excited are not equally spaced. This leads to a percussive sound, when the body is excited either by the string vibration, or the plucking device itself. Furthermore, instruments having a hollow, air filled body, also have a vibrational mode associated with the resonance of the air inside of the body. Generally, the air trapped in the body forms a Helmholz resonator, which is strongly coupled to the body and resonator.

In the following, various synthesis methodologies will be combined to produce a convincing simulation of the vibrational modes discussed above. The methodologies include wavetable synthesis, FM synthesis and physical modeling.

Wavetable synthesis involves repetition of p samples of a recorded instrument, over and over. Envelopes are also applied to further shape the signal. Assume $A_n$ is the $n^{th}$ sample produced by the synthesizer, then the mathematical result of wavetable synthesis is $$A_n=A_{n-p}$$

Here p is called the table length. It determines the amount of memory needed to store the wavetable, and the periodicity of the tone. Various pitches can be obtained by interpolation and/or decimation of the samples in the wavetable to produce larger or smaller numbers of samples, thus decreasing or increasing the perceived pitch.

FM synthesis uses multiple pairs of oscillators, whose outputs are weighted and added to produce the final sound. In each pair, one oscillator is the carrier and the other one is the modulator. The, the output of the oscillator pair can be described as:

$$S_n = A_n \sin(w_c * n + m(n) * \sin(w_m n)),$$

where $A_n$ is the carrier amplitude, $w_c$ is the carrier frequency, m(n) is the modulation amplitude, and $w_m$ is the modulation frequency. FM synthesis is particularly useful for the synthesis of nonharmonic tones since if the ratio $w_c/w_m$ is not an integer, $S_n$ has a non-harmonic spectrum, defined by Bessel functions.

In physical modeling synthesis, the wave equation for the string is numerically solved, using techniques such as delay lines, finite difference approximations, and finite element methods. If stiffness and other second order effects are neglected, the wave equation can be written as $$\partial^2 Y(x,t)/\partial x^2 = (1/c^2)\partial^2 Y(x,t)/\partial t^2,$$

where Y(x,t) is the lateral displacement, and c is the sound speed. The solutions to the wave equation are of the form $Y(x,t)=Y^+(x,t)+Y^-(x,t)$, where $Y^+$ and $Y^-$ are the traveling wave components. If the equation is discretized with $1/\Delta t$= sampling frequency, and $\Delta x/\Delta t=c$, then the equation can be solved using delay lines, analogous to waveguides which represent left and right traveling waves (see FIG. 1A). If $\Delta x/\Delta t \neq c$, then a more complicated finite difference approximation has to be used, since delay line model is not valid in this case.

Referring now to FIG. 1, a high quality embodiment of a plucked string synthesizer 10, is illustrated in general form. In this embodiment, synthesizer 10 includes a longitudinal vibratory tone (LVT) synthesis section 12, for synthesizing longitudinal vibratory transients. Further details on LVT section 12 will be provided below in connection with FIGS. 5A and 5B.

Synthesizer 10 further includes two transverse vibratory tone (TVT) sections 14 and 16, which synthesize the two components of transverse vibration of the string. These components are connected together by a bridge filter 18, for simulating the transfer of energy between the two transverse vibrational modes which occurs at the bridge of the plucked string instrument. Further details on TVT sections 14 and 16 and bridge filter 18, will be provided below in connection with FIG. 1A.

Synthesizer 10 of FIG. 1 further includes a tap tone (TT) synthesis section 20, which synthesizes the transients created by contact between the string and plucking device prior to release of the string and transverse vibration, and between notes when the string vibration is damped by the plucking device. TT section 20 is coupled to the bridge filter 18 and thereby to the TVT components 14 and 16. Bridge filter 18 implements the transmission and reflection coefficients in all directions. Under this approach, the simulated tap tone produced by TT section 20 establishes a boundary condition on the physically modeled TVT sections 14 and 16, equivalent to those imposed in a finite difference approximation, thus making a direct implementation of the physical model.

To produce an output signal, the outputs of TVT sections 14 and 16 are summed by an adder 22. The output of adder 22 is summed with the output of LVT section 12 by a second adder 24, producing a simulated plucked string instrument sound on line 26. In a digital embodiment, the simulated sound on line 26 comprises a sequence of digital samples, which is subsequently delivered to a digital to analog converter for driving one or more speakers.

Referring now to FIG. 1A, details of the TVT sections 14 and 16, and bridge filter 18, can be explained. In this embodiment, transverse vibrational modes of the string are synthesized by physical modeling, with a resonant circuit model such as is shown in sections 14 and 16 of FIG. 1A. Sections 14 and 16 are structurally identical, but mirror images of each other, and conjoin at bridge filter 18. (Although the various parameter values (scalar values, filter transfer functions) of corresponding components are set slightly differently, to simulate beating between the transverse vibrational modes.) Corresponding parts will be referred to collectively in the following discussion, with the parts in section 14 identified by the subscript "a" and parts in section 16 identified by the subscript "b". Each section includes delay lines 30*a*/30*b*, 32*a*/32*b*, 34*a*/34*b* and 36*a*/36*b*, and low pass filters 38*a*/38*b*, 40*a*/40*b*, 42*a*/42*b*, 44*a*/44*b*, 46*a*/46*b* and 48*a*/48*b*. Delay lines 30*a*/30*b* and 34*a*/34*b*, which have the same delay length, represent the portion of the string between the plucking device and the string tightening nut, when the string is engaged by the plucking device at the beginning and end of a note. Delay lines 32*a*/32*b* and 36*a*/36*b*, which have the same delay length, represent the portion of the string between the bridge and the plucking device.

Between the delay lines is a scattering junction 50*a*/50*b* which simulates the effect of engagement of the string by the plucking device. Specifically, the scattering junction determines the reflection and transmission coefficients for transverse vibratory waveforms being simulated by sections 14 and 16. For example, when the PD first engages the string, if the PD is pressed forcefully against the string, the PD almost fully damps vibrations at the point of contact with the string. This effectively divides the string in two, with no vibrations at the mid-point. In this case, all traveling wave components are constrained to the two divided halves of the string.

To model the resulting alteration in the string's mechanical properties, the scattering junction includes real-time adjustable scalars 52*a*/52*b*, 54*a*/54*b*, 56*a*/56*b* and 58*a*/58*b* for delivering signals from delay lines 30*a*/30*b* and 36*a*/36*b* into one or both of delay lines 32*a*/32*b* and 34*a*/34*b*, as appropriate.

For example, where the PD almost fully damps vibrations at its point of contact with the string, the signal output from delay line 36*a*/36*b* is reflected directly into delay line 32*a*/32*b* via scalar 58*a*/58*b*, with almost no signal passing through scalar 56*a*/56*b* to delay line 34*a*/34*b*. Similarly, in this circumstance, the signal output from delay line 30*a*/30*b* is reflected through scalar 54*a*/54*b* directly into delay line 34*a*/34*b*, with almost no signal passing through scalar 52*a*/52*b* to delay line 32*a*/32*b*. (The plucking device or plectrum is not absolutely stiff, and thus will move with the vibrating string and thus permit some signal to pass through, which is modeled by scalars 52*a*/52*b* and 56*a*/56*b* permitting a small amount of signal, say, 0.5%, to pass through even when the plucking device is fully engaged.)

Alternatively, when the plucking device is disengaged from the string, there are no such signal reflections, and all signal output from delay line 36*a*/36*b* is passed directly into delay line 34*a*/34*b* via scalar 56*a*/56*b*, with no signal reflecting through scalar 58*a*/58*b* to delay line 32*a*/32*b*. Similarly, in this circumstance, the signal output from delay line 30*a*/30*b* is passed directly through scalar 52*a*/52*b* directly into delay line 32*a*/32*b*, with no signal passing through scalar 54*a*/54*b* to delay line 34*a*/34*b*.

While the plucking device is in the process of engaging the string, partial reflections are produced, in which case both of each pair of scalars produce some pass through component and some reflected component. The sum of the scalars may be made equal to one as they are adjusted over time to simulate such partial reflections, or the sum may be made slightly less than one to model losses caused by the contact with the plucking device.

Thus, the plucking device motion can easily be simulated by simply adjusting transmission and reflection factors established by scalars 52*a*/52*b*, 54*a*/54*b*, 56*a*/56*b* and 58*a*/58*b*. This is particularly important right when the PD damps an already vibrating string, therefore takes a very important role for the articulation.

The result of adjusting the scalars of scattering junction 50 is to re-tune the resonant circuits of sections 14 and 16, because the resonant frequencies produced in sections 14 and 16 will depend on the delay length of the delay lines. The filters 38*a*/38*b* and 44*a*/44*b* are biquad low pass filters, and represent the losses in the string and the reflection coefficient on the bridge and the nut. Filters 40*a*/40*b*, 42*a*/42*b*, 46*a*/46*b* and 48*a*/48*b* are first order allpass filters, used to tune the pitch and generate inharmonicity by introducing phase delays. The resulting filter matrix is at least of the third order, preferably fourth order. This guarantees a perfect match of the decay profile for the complete pitch range of the plucked string instrument.

To produce a simulation of the transverse vibration of the string, the delay lines are initialized with triangular waveforms. That is, delay lines 30*a*/30*b* and 34*a*/34*b* are initialized with samples starting at zero at the connection to filters 42*a*/42*b* and 38*a*/38*b*, and increasing to a maximum value at the opposite end of delay lines 30*a*/30*b* and 34*a*/34*b*, and delay lines 32*a*/32*b* and 36*a*/36*b* are initialized with samples starting at the maximum value at their connection to delay lines 30*a*/30*b* and 34*a*/34*b*, and decreasing to a zero value at their opposite ends. This triangular initial pattern simulates the transverse deflection of the string at the moment the string is released by the plucking device. This is an intuitive and physically correct choice, and the spectrum exhibits missing harmonics at the correct frequencies. It will be appreciated that in an actual deflected string, there is not a sharp corner at the point of maximum deflection, but rather a curve due to the finite size and flexibility of the plucking device when it is deflecting the string. Accordingly, an even more precise initialization would round the peak of the triangular initial pattern.

The scalars 52*a*/52*b*, 54*a*/54*b*, 56*a*/56*b* and 58*a*/58*b* are adjusted according to the time intervals and the corresponding transients discussed below in FIG. 3. For $t_{long}<t<t_{end}$, the transmission coefficients of scalars 52*a*/52*b* and 56*a*/56*b* in both directions are 1.0 and the reflection coefficients of scalars 54*a*/54*b* and 58*a*/58*b* are 0.0. As soon as the string starts to be damped, the plucking device constraints the displacement. The string displacement becomes zero at $t=t_{end}$. It then quickly becomes negative and excites the divided portions of the string. Thus from just prior to $t=t_{end}$ through $t=t_{end}$ and $t=t_{end}+t_{damp}$, the reflection coefficients of scalars 54*a*/54*b* and 58*a*/58*b* are increased toward a value near 1.0, and the transmission coefficients of scalars 52*a*/52*b* and 56*a*/56*b* are decreased to a value close to zero such as 0.05. Depending on the excitation, the progressions of the scalar transmission coefficients can be made non-symmetric; furthermore, to introduce additional losses, the sum of the reflection and transmission coefficients on one side can be made less than 1.0.

As discussed above, the transverse vibrational mode synthesizer shown in FIG. 1A models the beating between two transverse modes, through interaction at the bridge filter 18, details of which are shown in FIG. 1. The bridge filter is, in essence, another scattering junction, including frequency-domain filters 61*a*/61*b* modeling reflection of transverse mode vibrations into the same mode, and filters 63*a*/63*b* modeling transference of transverse mode vibrations from one mode to the opposite mode. The parameters of these filters are not modified during the course of a note, however, these parameters are frequency dependent, to maximize the modeling of the bridge coupling between the transverse modes. The reflected and transferred signals from filters 61*a*/61*b* and 63*a*/63*b* are added at an adder 65*a*/65*b* and delivered to filter 46*a*/46*b* to stimulate the appropriate mode of the string.

As noted above, the simulated tap tone produced by TT section 20 establishes a boundary condition on the physically modeled TVT sections 14 and 16. This is implemented by delivering the output of the TT section 20, multiplied by a scalar 67*a*/67*b*, into adder 65*a*/65*b*, thus using the TT section 20 output as part of the initial stimulation of the transverse vibrational modes and establishing a boundary condition on the traveling waves in each transverse mode.

Figure 2:
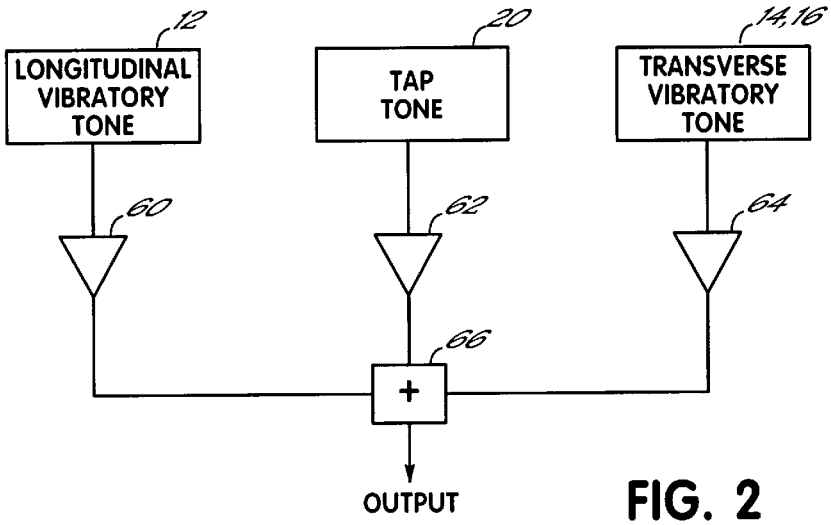
FIG. 2 is a block diagram of an alternative embodiment of a plucked string instrument synthesizer in accordance with principles of the present invention.

A simplified embodiment of a plucked string instrument synthesizer is shown in FIG. 2. This embodiment includes many of the units discussed above, but the interaction between the units is less complex. Specifically, this embodiment includes a longitudinal vibratory tone section 12, tap tone section 20 and transverse vibratory tone section 14,16. The outputs of these sections are weighted by scalar amplifiers 60, 62 and 64, and then summed by an adder 66. This embodiment does not provide the reproduction quality of the previous embodiment, since it cannot simulate, for example, the coupling between the body and the strings at the bridge. The resulting interactions between the tap tone and the transverse vibrational tones may not be accurately represented by the simple addition of the output of TT section 20 and the outputs of the TVT sections 14 and 16.

The physical modeling synthesis described above and illustrated in FIG. 1A, uses many delay lines and filters, and thus may be expensive to implement. In a simplified embodiment such as that shown in FIG. 2, a lower quality TVT model can be constructed by using wavetable synthesis of the two transverse vibrational modes. The two separately synthesized transverse vibrational components are then added, producing a beating which can be a convincing simulation of the TVT modes. The summed output is then multiplied by a time envelope having the same rise shape as the envelope used by the attack section of the TT section (produced by envelope circuit 82, shown in FIG. 4, below). This is done to ensure that the TT and TVT components are perceived as a single tone by using identical rise envelopes.

The simplified synthesizer of FIG. 2, while including modeling for the longitudinal vibratory tone as well as the attack and damp tap tones, lacks the dynamic inter-mode interaction which can be implemented in physical modeling of TVT. Furthermore, in this model, it is not possible to use the TT section 20 to establish boundary conditions for the TVT section, as described above. Accordingly, the results produced are likely to be a less convincing simulation than those of the more complex model illustrated in FIG. 1.

Figure 3:
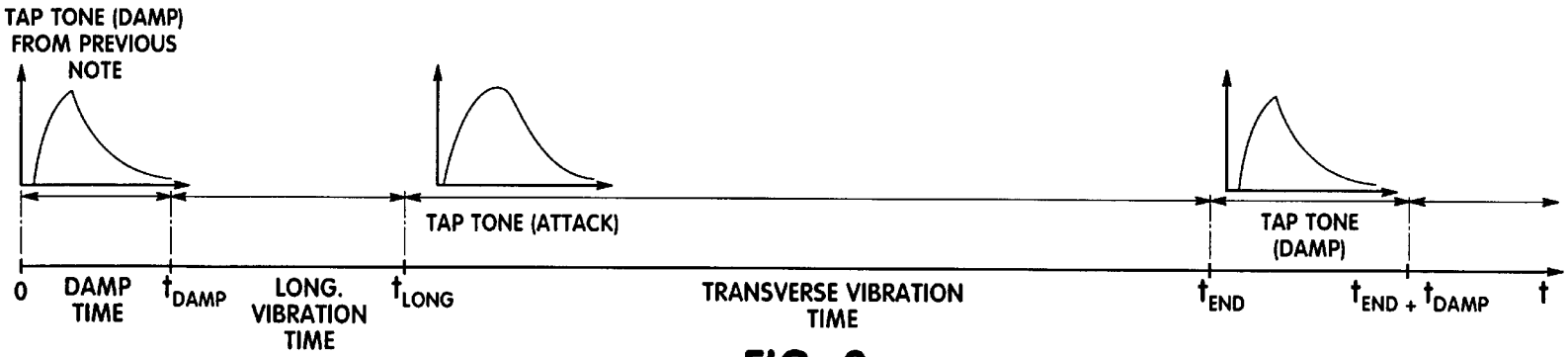
FIG. 3 is a timing diagram illustrating the timing of the various transients simulated in accordance with principles of the present invention.

Referring now to FIG. 3, an explanation can be made of the time ordering and relationships between the TVT, TT and LVT components used in the embodiments of FIGS. 1 and 2. As seen in FIG. 3, the sounds produced by a plucked string instrument through a single played note beginning at time t=0, and ending at time $t=t_{end}+t_{damp}$, can be categorized as follows:

| | |
|---|---|
| $0 < t < t_{damp}$ | During this period, the vibrations for the previous note are damped as the PD is placed against the string to play the note. This produces a very short duration buzzing noise at this moment, continuing until the PD starts to slide on the string. This buzzing noise is simulated by a damping tap tone in this region. |
| $t_{damp} < t < t_{long}$ | During this period, a longitudinal vibration tone (LVT) is produced, due to sliding of the PD along the string. The duration of this interval depends on the speed of the PD and the angle of the PD as it strikes the string (i.e., whether the PD is parallel or perpendicular to the string.) |
| $t_{long} < t < t_{end}$ | At the beginning of this period, the transverse vibrational modes of the string are excited by the release of the string from the PD. The energy transfer from the string to the body of the instrument also produces a tap tone, simulated by an attack tap tone in this region. |
| $t_{end} < t < t_{end} + t_{damp}$ | During this period, the vibrations for the note are damped as the PD is placed against the string to play the subsequent node. The duration of this interval is usually not the same as the damp duration of the previous note, and accordingly an appropriate simulation incorporates variation in the damping time between individual articulated notes. |

Figure 4A:
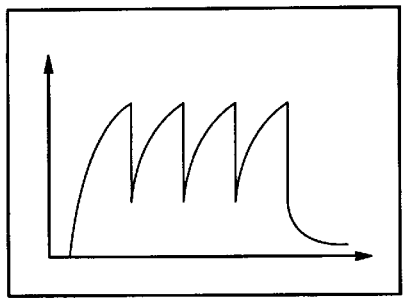
FIG. 4A is an illustration of a sawtooth waveform used in conjunction with the tap tone section shown in FIG. 4 to simulate the tap tone produced by a wound string.
Figure 4:
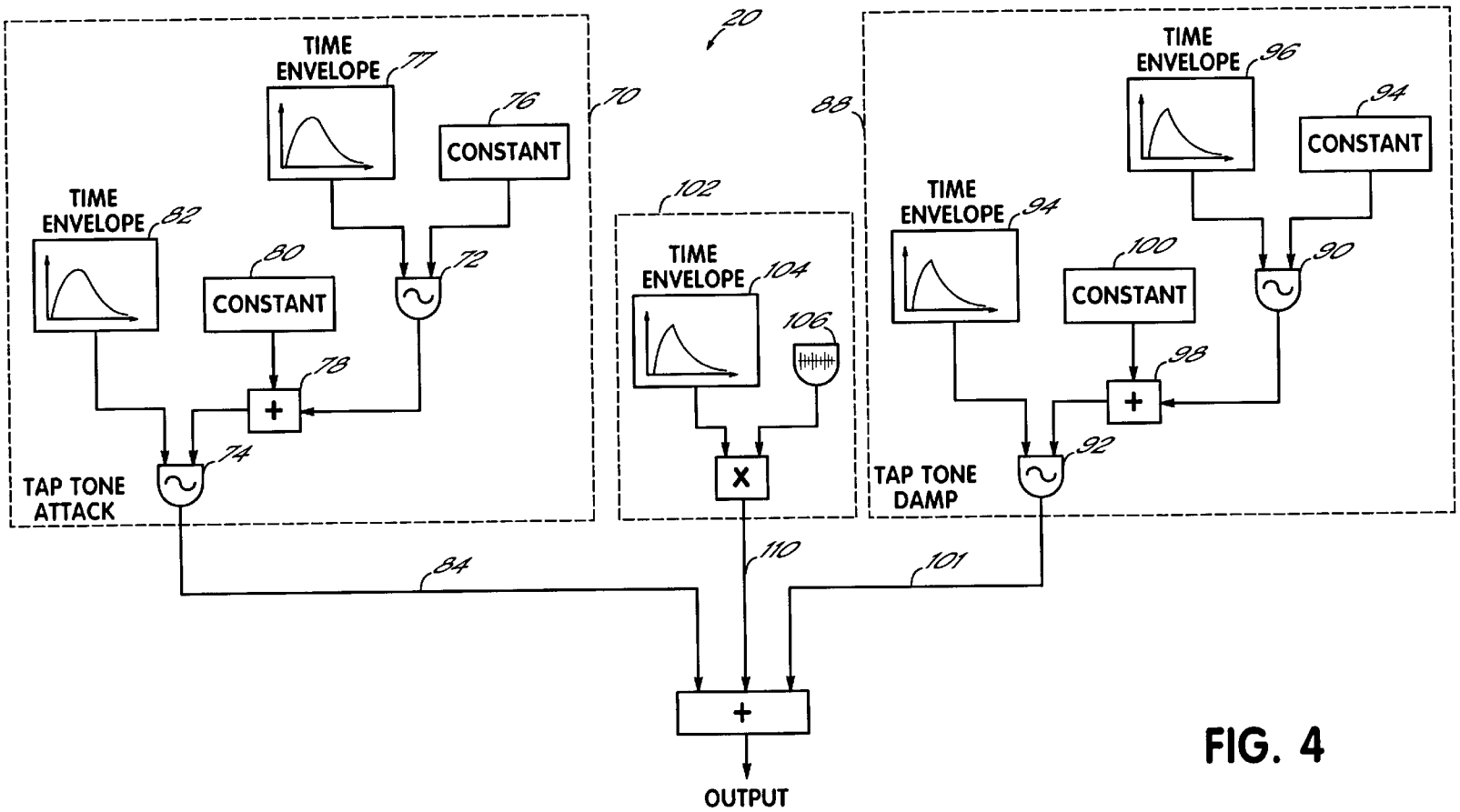
FIG. 4 is a detailed block diagram of the tap tone section of the plucked string instrument synthesizers of FIGS. 1 and 2.

Referring to FIG. 4, details of the tap tone section 20 can be provided. The tap tone is efficiently produced by FM synthesis. A physical model is likely to be less efficient, because the body is more than two dimensional. This means that a physical model would have to include many delay lines coupled to each other, in particular a two or three dimensional waveguide mesh. The FM synthesis model, used in the embodiment illustrated in FIG. 4, has substantially reduced complexity.

Referring first to the attack tap tone section 70, the tap tone is simulated by a frequency modulated carrier. There are two main occurrences of the attack tap tone TT: The first one is at the initial attack of the PD on the string before it starts to vibrate (or when the previous note is damped) and the second occurrence is when PD releases the string and the string transfers part of the energy into the body and/or the resonator. Once the second oscillation has been stimulated, both can be heard simultaneously. Therefore, two oscillators 72 and 74 are used to produce the desired output.

Each oscillator 72, 74 has a first input controlling the oscillator output frequency, and a second input controlling the oscillator output amplitude. The frequency input to the first oscillator 72 is coupled to a constant 76, which thus produces a constant oscillation frequency. The amplitude input to the first oscillator 72 is connected to an envelope circuit 77 which, once triggered, outputs a defined time enveloped waveform as illustrated in FIG. 4. Thus, the output of oscillator 72 is a time-enveloped, constant frequency alternating waveform.

The output of oscillator 72 is fed to an adder 78. The second input of adder 78 is coupled to a constant 80. Thus, the output of adder 78 is the time-enveloped, constant frequency alternating waveform produced by oscillator 72, superimposed upon a constant baseline value.

The output of adder 78 is connected to the frequency input of the second oscillator 74. The amplitude input of oscillator 74 is connected to a second envelope circuit 82 which produces a time-enveloped waveform as illustrated in FIG. 4. Thus, the output of oscillator 74 on line 84 is a carrier frequency corresponding to the constant 80, frequency modulated according to the envelope of envelope circuit 77, and amplitude modulated according to the envelope of envelop circuit 82. This waveform is an accurate representation of the attack tap tone produced by engagement of the string with the plucking device.

Referring now to the damp tap tone section 88, the damp tap tone is again simulated by a frequency modulated carrier. Here again, two oscillators 90 and 92 are used to produce the desired output. The frequency input to the first oscillator 90 is coupled to a constant 94, which thus produces a constant oscillation frequency. The amplitude input to the first oscillator 90 is connected to an envelope circuit 96 which, once triggered, outputs a defined time enveloped waveform as illustrated in FIG. 4. The output of oscillator 90 is fed to an adder 98. The second input of adder 98 is coupled to a constant 100. Thus, the output of adder 98 is the time-enveloped, constant frequency alternating waveform produced by oscillator 90, superimposed upon a constant baseline value. This output is connected to the frequency input of the second oscillator 92. The amplitude input of oscillator 92 is connected to a second envelope circuit 94 which produces a time-enveloped waveform as illustrated in FIG. 4. Thus, the output of oscillator 92 on line 101 is a carrier frequency corresponding to the constant 100, frequency modulated according to the envelope of envelope circuit 96, and amplitude modulated according to the envelope of envelop circuit 94. This waveform is an accurate representation of the damp tap tone produced by engagement of the plucking device against a transversely vibrating string.

The time envelope blocks 77, 82, 94 and 96 of FIG. 4 are triggered appropriately at the start and end times of longitudinal and transverse vibrations. The damp portion 88 is triggered at time t=0 and $t=t_{end}$ of FIG. 3, and heard at the end of each note. The attack portion 70 is triggered at time $t=t_{long}$ shown in FIG. 3, and heard at the beginning of a note. The envelopes for each of blocks 77, 82, 94 and 96 are chosen depending on the specific geometry and vibrational modes of the simulated plucked string instrument. These may be determined, for example, from recordings for a range of performance parameters such as PD speed, its position relative to the bridge, and its angle. In some cases it may be necessary to include one or more additional sections similar to sections 70 and 88 to appropriately simulate all of the frequencies present in the attack or damp tap tone, depending upon the instrument used.

At the very early moments of the tap tone, particular during the attack, the frequency spectrum of the generated sound is quite broad. To adequately simulate this early spectrum, an enveloped white noise, produced by section 102, is superimposed on the FM synthesized tap tones produced by section 70 and/or 88. Section 102 includes a time envelope circuit 104, which produces when triggered a time envelope as shown in FIG. 4, and a random signal generator 106 for generating white noise. The outputs of envelope circuit 104 and white noise generator 106 are delivered to a multiplier 108, which produces the product of these signals on line 110. The signal on line 110 is, therefore, a brief pulse of white noise. The envelope produced by circuit 104 is similarly determined from recordings of the instrument with various parameter variations.

Additional issues may be raised in synthesizing the tap tone in the case of wound or very rough strings. In this case when PD slides on the string, the plucked string instrument will produce continuously re-stimulated tap tones, as the PD strikes each of the windings or rough features of the string. Each time the PD skips a winding in the case of wound strings, and strikes the following winding, the envelope value increases. This process is repeated with a frequency which is related to the lateral speed of the PD, and for a number of times which is related to the angle of the PD to the string. The faster the PD, the more often windings are skipped, and the produced tone has a higher frequency. Furthermore, the sharper the angle of the PD to the string, the more windings will be skipped, and the greater number of times that the amplitude increases.

To simulate such a behavior, the envelopes used in circuits 77, 82, 94 and/or 96 may have a sawtooth shape. An example envelope is shown in FIG. 4A. Alternatively, it may be desirable to include, in addition to sections 70 and 88, which simulate a primary tap tone, an additional section having a similar configuration, in which the envelope circuits include sawtooth envelopes such as is shown in FIG. 4A, to simulate the additional tap tones created by the PD skipping string windings.

Figure 5B:
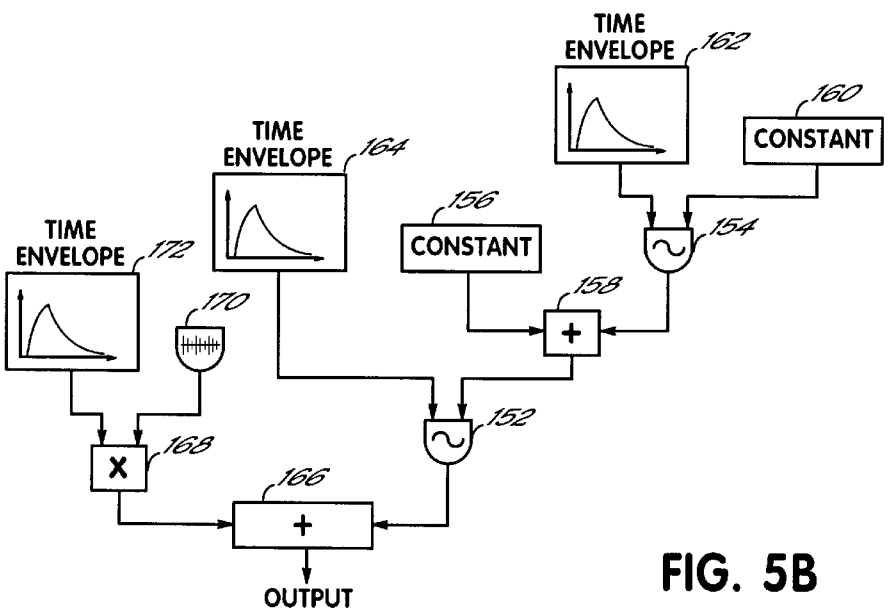
FIG. 5B is a detailed block diagram of a second embodiment of the longitudinal vibratory tone section of the plucked string instrument synthesizer of FIGS. 1 and 2.
Figure 5A:
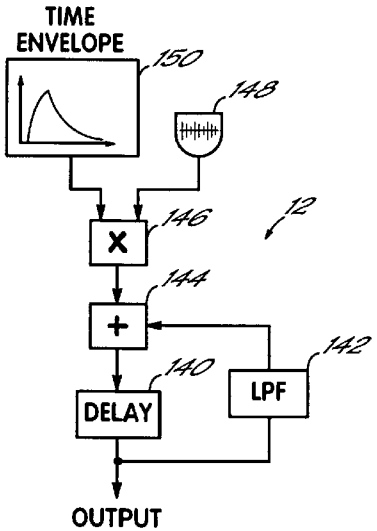
FIG. 5A is a detailed block diagram of a first embodiment of the longitudinal vibratory tone section of the plucked string instrument synthesizers of FIGS. 1 and 2.

Referring now to FIG. 5A, the synthesizer modeling the longitudinal vibration of the string can be discussed. In this embodiment, the synthesizer contains a delay line 140, a low-pass filter 142 connected in a loop via an adder 144. The second input of adder 144 receives enveloped white noise produced by multiplier 146. Multiplier 146 generates white noise by multiplying white noise from generator 148, by an envelope produced by envelop circuit 150. Thus, the longitudinal vibrational mode is stimulated by white noise, simulating the friction between the plucking device and the string which excites this mode. (For some plucked string instruments, when the plucking device slides on the string, because of the string roughness, some noise is also heard superimposed on the perceivable pitch. This noise is more significant in nylon or gut strings, compared to steel strings.)

In the embodiment of FIG. 5A, the pitch of the longitudinal vibrational mode is adjusted by the length of the delay line 140, and the coefficients of the low pass filter 142 (because of additional phase delay that the filter introduces). The envelope produced by circuit 150, is adjusted to shape the tone of this longitudinal mode, as a function of the plucking device speed and angle, or equivalently the duration of the longitudinal mode excitation.

Referring now to FIG. 5B, in an alternative embodiment, the longitudinal mode may be synthesized using a frequency modulation model. In this embodiment, one pair of frequency modulators 152, 154 is used, which is sufficient because the longitudinal vibrational mode produces vibrations which are close to harmonic. Moreover, since the duration of the vibration is very short, the simpler model gives the same perception as a more theoretically correct one. Here again, a carrier frequency is established by a constant 156 fed into an adder 158, the output of which drives the frequency control input of modulator 152. The second input of adder 158 is connected to the output of modulator 154 to receive the modulated signal. The frequency of the modulated signal is determined by a constant 160 applied to the frequency control input of modulator 154, enveloped by an envelope produced by envelope circuit 162 and applied to the amplitude control input of modulator 154. The amplitude of the frequency-modulated carrier is controlled by an envelope produced by envelope circuit 164 and applied to the amplitude control input of modulator 152. The carrier and modulator frequencies are adjusted according to the pitch of the longitudinal vibrational mode, which is determined by the length of the string of the plucked string instrument. A noise component, is added to this frequency modulated carrier by an adder 166, to account for the string roughness. The noise is enveloped white noise, produced at the output of multiplier 168 which multiplies the output of a white noise generator 170 by an envelope from envelope circuit 172.

A software appendix is attached to this application. The program described in this appendix is written for the LISP programming language, and uses a common LISP music package to model unit signal generators such as filters, delay lines, etc. The program can be invoked with the command ":c1 filename". The program output simulates classical guitar sounds in accordance with principles of the present invention. The main variables used in the software simulation and their interdependence can be represented as follows:

PD speed=function( )
PD distance from bridge=function( )
PD angle from String=function( )
Attack tap amplitude=function(PD speed)
Attack tap duration=function(Attack Tap Amplitude)
longitudinal duration=function(PD speed, PD angle from String)
Damp tap amplitude=function(PD speed, PD distance from bridge)
Damp tap duration=function(Damp tap amplitude)
Damp duration=function(PD speed)
Wound long pitch=function(PD speed)

While the present invention has been illustrated by a description of various embodiments and while these embodiments have been described in considerable detail, it is not the intention of the applicants to restrict or in any way limit the scope of the appended claims to such detail. Additional advantages and modifications will readily appear to those skilled in the art.

For example, if the lengths of the delay lines illustrated in FIG. 1A are arranged so that the scattering filters 50*a*/50*b* are at the approximate location of the nut end of the string, the model can simulate the effect of a thumb finger damping the string adjacent to the nut portion.

Damping noise, which in the above embodiment is modeled by changing the transmission and reflection coefficients of the scattering junctions of FIG. 1A, can be implemented differently, for example by averaging various tap points along the delay lines, and using the average as the output. A very small amplitude white noise may also be added (this noise is particularly loud in harpsichords).

The transition from longitudinal to transverse modes may be smoothed by applying a fader to the inputs of adder 24 in FIG. 1, so that as the TVT fades in, the LVT fades out after $t_{long}$.

Other pure percussive tones can also be simulated. In most PSI's, pure percussive tones can be produced as special effects. All these can easily and simply be synthesized by modifying the FM synthesis parameters in the TT producing unit 20.

In the tambora technique, one of the techniques in classical guitar, the hand hits the strings right on the bridge. This can be implemented by introducing finite values to the bridge side of the delay lines illustrated in FIG. 1, in other words by setting the boundary conditions as finite at the bridge.

Hand squeak noise may also be simulated. This noise is produced on rough or wound strings of PSI's, when the skin slides on the string. If the string is not wound, the pitch is essentially the fundamental frequency of the longitudinal mode. If the string is wound, it consists of two superimposed sounds: LVT and TT with a sawtooth shaped envelope as shown in FIG. 4A, and can be produced in this manner using the embodiments of either FIG. 1 or FIG. 2. A higher degree of accuracy may be obtained by introducing a slight frequency modulation, since the finger speed is not constant when going from one note to another. In fact, the finger speed has a contour which can exactly be determined from studio recordings.

On PSI's with a fretboard, the left hand fingers can be used to articulate ascending slurs, which are essentially obtained by hitting the fingerboard. This produces a percussive sound just as in the longitudinal vibration starting at the same time as TT, and can be modeled by an additional TT component. Since the left hand hits usually hits a distance from the resonator, this TT has a small amplitude.

A descending left hand slur is also typical to PSI's with a fingerboard. An ascending slur is played by a finger which essentially pulls the string and produces a TT as soon as the TVT starts. So this articulation can be synthesized simply turning the LVT unit off, and changing the delay length in TVT delay lines shown in FIG. 1, in real time.

Harmonics can be very easily implemented by dividing one of the waveguides shown in FIG. 1A into two. This simulates one finger stopping some point on the string while PD plays at a different location.

Various other plucking techniques produce different damping noises. For example in classical guitar, the finger divides the string into two when damping the previous note. If the thumb is playing, the nut portion of the string is damped by the flesh of the thumb. If the other fingers are playing on the other hand, the bridge portion of the vibration is damped by the flesh. These techniques can be very easily incorporated into the model by changing transmission and reflection coefficients in the filters of FIG. 1 in order to simulate the activity.

The invention in its broader aspects is therefore not limited to the specific details, representative apparatus and method, and illustrative example shown and described. Accordingly, departures may be made from such details without departing from the spirit or scope of applicant's general inventive concept.

What is claimed is:

1. A synthesizer for simulating attack transients created by plucking a string of a plucked string musical instrument, comprising a first transient circuit producing a first simulation of an audible attack transient having a first duration, a second transient circuit producing a second simulation of an audible attack transient having a second duration, a resonant circuit tuned to a fundamental natural frequency of the plucked string to produce a simulation of an audible tone, for a third duration longer than the first or second duration, wherein each said transient circuits is connected to said resonant circuit to stimulate the resonant circuit to produce an audible tone simulating the sound of the plucked string instrument.

2. The synthesizer of claim 1, wherein said resonant circuit is tuned to a fundamental natural frequency of transverse virbration of the plucked string.

3. The synthesizer of claim 1, wherein said resonant circuit comprises first and second delay elements and first and second filtering circuits, an output of said first delay element connected to an input of said first filtering circuit, an output of said first filtering circuit connected to an input of said second delay element, an output of said second delay element connected to an input of said second filtering circuit, an output of said second filtering circuit connected to an input of said first delay element.

4. The synthesizer of claim 3 wherein said resonant circuit has a fundamental natural frequency equal to the fundamental frequency of the simulated tone, and said first and second delay lines comprise said second transient circuit by initializing said first and second delay lines with waveforms representative of transverse deflection of a string as part of plucking the string.

5. The synthesizer of claim 4 wherein said waveforms are triangular in shape.

6. The synthesizer of claim 3 further comprising a scattering junction coupled to the first and second delay elements, for controllably reflecting an adjustable portion of signals passing through the first delay element into the second delay element, and controllably reflecting an adjustable portion of signals passing through the second delay element into the first delay element, and vice-versa.

7. The synthesizer of claim 6 wherein during a final damping period at the end of a simulated tone, said scattering junction is controllably adjusted to reflect a substantially larger portion of signals passing through the first and second delay elements than at times prior to said damping period.

8. The synthesizer of claim 6 wherein said first and second delay elements each comprise a nut-PD delay section simulating delays in signal propagation between a nut of said plucked string instrument and a plucking device PD, and a PD-bridge delay section simulating delays in signal propagation between a plucking device PD and a bridge of said plucked string instrument, wherein said scattering junction is coupled to each delay element between the nut-PD delay section and PD-bridge delay section of the delay element.

9. The synthesizer of claim 1 wherein said first transient circuit comprises first and second oscillators, an output of said first oscillator controlling a frequency produced by said second oscillator, such that said second oscillator produces a frequency modulating carrier.

10. The synthesizer of claim 9 wherein said first transient circuit further comprises a noise generator, an output of said noise generator being combined with an output of said second oscillator to generate a synthesized transient.

11. The synthesizer of claim 1 wherein said resonant circuit has a fundamental natural frequency equal to the fundamental frequency of the simulated tone, and further comprising a a longitudinal vibration synthesis section for producing a simulation of longitudinal vibration of the string, wherein outputs of said resonant circuit and said longitudinal vibration synthesis section are combined to produce an output signal simulating the sound of the plucked string instrument.

12. A synthesizer for simulating transient longitudinal vibration and longer-term transverse vibration of a string caused by plucking a string of a plucked string musical instrument, comprising a transverse vibration synthesis section for producing a simulation of an audible tone for the transverse vibration of the string, and a longitudinal vibration synthesis section for producing a simulation of longitudinal vibration of the string, wherein outputs of the transverse and longitudinal vibration synthesis sections are combined to produce an output signal simulating the sound of the plucked string instrument.

13. The synthesizer of claim 12, wherein the longitudinal synthesis section is stimulated by a sawtooth waveform, thus simulating the transients produced upon plucking a wound string of a plucked string instrument.

14. The synthesizer of claim 12, wherein said transverse vibration synthesis section comprises first and second delay elements and first and second filtering circuits, an output of said first delay element connected to an input of said first filtering, circuit, an output of said first filtering circuit connected to an input of said second delay element, an output of said second delay element connected to an input of said second filtering circuit, an output of said second filtering circuit connected to an input of said first delay element.

15. The synthesizer of claim 14 wherein said transverse vibration synthesis section has a fundamental natural frequency equal to the fundamental frequency of the simulated tone, and said transverse vibration synthesis section is further stimulated by initializing said first and second delay lines with waveforms representative of transverse deflection of a string as part of plucking the string.

16. The synthesizer of claim 15 wherein said waveforms are triangular in shape.

17. The synthesizer of claim 14 further comprising a scattering junction coupled to the first and second delay elements, for controllably reflecting an adjustable portion of signals passing through the first delay element into the second delay element, and controllably reflecting an adjustable portion of signals passing through the second delay element into the first delay element.

18. The synthesizer of claim 17 wherein during a final damping period at the end of a simulated tone, said scattering junction is controllably adjusted to reflect a substantially larger portion of signals passing through the first and second delay elements than at times prior to said damping period.

19. The synthesizer of claim 17 wherein said first and second delay elements each comprise a nut-PD delay section simulating delays in signal propagation between a nut of said plucked string instrument and a plucking device PD, and a PD-bridge delay section simulating delays in signal propagation between a plucking device PD and a bridge of said plucked string instrument, wherein said scattering junction is coupled to each delay element between the nut-PD delay section and PD-bridge delay section of the delay element.

20. A synthesizer for simulating transients produced during damping of a vibrating string of a plucked string musical instrument, comprising a note synthesis section producing a simulation of an audible tone corresponding to a simulated note, which has a first duration extending from the time of a simulated pluck of the string through a final damping period preceding a subsequent simulated pluck of a string, and a transient synthesis section producing a simulation of an audible transient, which has a second duration shorter than the first duration, said simulation of an audible transient being synthesized during the final damping period, wherein outputs of the note and transient synthesis sections are combined to produce an output signal simulating the sound of the plucked string instrument during the damping period.

21. The synthesizer of claim 20, wherein said note synthesis section comprises first and second delay elements and first and second filtering circuits, an output of said first delay element connected to an input of said first filtering circuit, an output of said first filtering circuit connected to an input of said second delay element, an output of said second delay element connected to an input of said second filtering circuit, an output of said second filtering circuit connected to an input of said first delay element.

22. The synthesizer of claim 21 wherein said note synthesis section has a fundamental natural frequency equal to the fundamental frequency of the simulated tone, and said note synthesis section is stimulated by initializing said first and second delay lines with waveforms representative of transverse deflection of a string as part of plucking the string.

23. The synthesizer of claim 22 wherein said waveforms are triangular in shape.

24. The synthesizer of claim 21 further comprising a scattering junction coupled to the first and second delay elements, for controllably reflecting an adjustable portion of signals passing through the first delay element into the second delay element, and controllably reflecting an adjustable portion of signals passing through the second delay element into the first delay element.

25. The synthesizer of claim 24 wherein during a final damping period at the end of a simulated tone, said scattering junction is controllably adjusted to reflect a substantially larger portion of signals passing through the first and second delay elements than at times prior to said damping period.

26. The synthesizer of claim 24 wherein said first and second delay elements each comprise a nut-PD delay section simulating delays in signal propagation between a nut of said plucked string instrument and a plucking device PD, and a PD-bridge delay section simulating delays in signal propagation between a plucking device PD and a bridge of said plucked string instrument, wherein said scattering junction is coupled to each delay element between the nut-PD delay section and PD-bridge delay section of the delay element.

27. A synthesizer for simulating transients produced during damping of a vibrating string of a plucked string musical instrument, comprising a note synthesis section producing a simulation of an audible tone corresponding to a simulated note, which has a first duration extending from the time of a simulated pluck of the string through a final damping period preceding a subsequent simulated pluck of a string, the note synthesis section comprising first and second filters, each having an input and an output and producing at the output a frequency-filtered version of a signal delivered at the input, a first delay element connecting signals output from the first filter to the input of the second filter, a second delay element connecting signals output from the second filter to the input of the first filter, and a scattering junction coupled to the first and second delay elements, for controllably reflecting an adjustable portion of signals passing through the first delay element into the second delay element, and controllably reflecting an adjustable portion of signals passing through the second delay element into the first delay element, and vice-versa, wherein during said final damping period, said scattering junction of said note synthesis section is controllably adjusted to reflect a substantially larger portion of signals passing through the first and second delay elements than at times prior to said damping period.

28. The synthesizer of claim 27 wherein said first and second delay elements each comprise a nut-PD delay section simulating delays in signal propagation between a nut of said plucked string instrument and a plucking device PD, and a PD-bridge delay section simulating delays in signal propagation between a plucking device PD and a bridge of said plucked string instrument, wherein said scattering junction is coupled to each delay element between the nut-PD delay section and PD-bridge delay section of the delay element.

29. A method for simulating attack transients created by plucking a string of a plucked string musical instrument, comprising providing a resonant circuit tuned to a fundamental natural frequency of the plucked string, which when stimulated produces a simulation of an audible tone, for a first duration, producing a simulation of a first audible attack transient having a second duration shorter than the first duration, producing a simulation of a second audible attack transient having a third duration shorter than the first duration, delivering the simulations of audible attack transients to the resonant circuit to stimulate the resonant circuit to produce an audible tone simulating the sound of the plucked string instrument.

30. A method for simulating transient longitudinal vibration and longer-term transverse vibration of a string caused by plucking a string of a plucked string musical instrument, comprising producing a simulation of an audible tone for the transverse vibration of the string, and producing a simulation of longitudinal vibration of the string, combining the simulated transverse and longitudinal vibrations to produce an output signal simulating the sound of the plucked string instrument.

31. A method for simulating transients produced during damping of a vibrating string of a plucked string musical instrument, comprising producing a simulation of an audible tone corresponding to a simulated note, which has a first duration extending from the time of a simulated pluck of the string through a final damping period preceding a subsequent simulated pluck of a string, and producing a simulation of an audible transient, which has a second duration shorter than the first duration, said simulation of an audible transient being produced during the final damping period, combining the simulated note and simulated audible transient to produce an output signal simulating the sound of the plucked string instrument during the damping period.

32. A method for simulating transients produced during damping of a vibrating string of a plucked string musical instrument, comprising providing a note synthesizer producing a simulation of an audible tone corresponding to a simulated note, which has a first duration extending from the time of a simulated pluck of the string through a final damping period preceding a subsequent simulated pluck of a string, the note synthesis section comprising first and second filters, each having an input and an output and producing at the output a frequency-filtered version of a signal delivered at the input, a first delay element connecting signals output from the first filter to the input of the second filter, a second delay element connecting signals output from the second filter to the input of the first filter, and a scattering junction coupled to the first and second delay elements, for controllably reflecting an adjustable portion of signals passing through the first delay element into the second delay element, and controllably reflecting an adjustable portion of signals passing through the second delay element into the first delay element, and vice-versa, and adjusting the scattering junction of the note synthesizer during the damping period to reflect a substantially larger portion of signals passing through the first and second delay elements than at times prior to said damping period.

* * * * *